United States Patent [19]

Hagihara et al.

[11] Patent Number: 4,650,097

[45] Date of Patent: Mar. 17, 1987

[54] DEVELOPER MATERIAL SUPPLY ARRANGEMENT

[75] Inventors: Hideaki Hagihara, Moriguchi; Masaru Nishijima, Hirakata, both of Japan

[73] Assignee: Sharp Kabushiki Kaisha, Osaka, Japan

[21] Appl. No.: 684,739

[22] Filed: Dec. 21, 1984

[30] Foreign Application Priority Data

Dec. 27, 1983 [JP] Japan ..... 58-200264[U]
Dec. 27, 1983 [JP] Japan ..... 58-200265[U]

[51] Int. Cl.[4] ..... B67D 5/64; B65D 5/72; G03G 15/00

[52] U.S. Cl. ..... 222/161; 222/196; 222/185; 222/463; 222/498; 222/DIG. 1; 366/111; 355/3 DD

[58] Field of Search ..... 222/DIG. 1, 173, 505, 222/161, 162, 498, 463, 181, 185, 196; 366/108, 111, 114; 355/3 DD

[56] References Cited

U.S. PATENT DOCUMENTS 3,616,969 11/1971 Koizumi ..... 222/161
4,237,943 12/1980 Ermel et al. ..... 222/DIG. 1
4,293,085 10/1981 Nakajima et al. ..... 222/DIG. 1
4,491,161 1/1985 Tamura et al. ..... 222/DIG. 1
4,583,660 4/1986 La Barrie et al. ..... 222/DIG. 1 X

FOREIGN PATENT DOCUMENTS 1036526 9/1953 France ..... 222/505

*Primary Examiner*—F. J. Bartuska
*Assistant Examiner*—Gregory L. Huson
*Attorney, Agent, or Firm*—Birch, Stewart, Kolasch & Birch

[57] ABSTRACT

A developer material supply arrangement which includes a developer hopper mounting portion for detachably mounting a developer hopper on the mounting provided portion at an opening at the upper portion of a developing tank of an electrophotographic copying apparatus, a hopper-shaped container for a developer material, a supply port provided at a lower portion of the hopper-shaped container and formed into a configuration which can be detachably mounted with respect to the developer hopper mounting portion, and a valve member provided within the supply port for selective opening or closing of the supply port.

4 Claims, 7 Drawing Figures

DEVELOPER MATERIAL SUPPLY ARRANGEMENT

BACKGROUND OF THE INVENTION

The present invention generally relates to an electrophotographic copying apparatus or the like, and more particularly, to a developer material supply arrangement for feeding developing material to a developer tank of an electrophotographic copying apparatus, and also to an improvement of the developing tank.

In an electrophotographic copying apparatus, the developer material is generally supplied into the developing tank thereof upon installation of the copying apparatus, and also, when the developer material which has been used for a predetermined amount of time is to be replaced.

Conventionally, however, it has been a common practice to effect the supply of the developer material as referred to above by removing the developing tank from the apparatus so as to remove its upper lid for charging the developer material thereinto, and therefore, for the supply of the developer material, a special person in charge is necessary for attaching and detaching the developing tank, with troublesome procedures being simultaneously required. Meanwhile, a conventional practice has also been developed in which the developer material is accommodated in a cartridge or the like to facilitate the supply thereof to the developing tank, but in this case, an arrangement for discharging the developer material from the cartridge is required, while a mechanism for operating such an arrangement must further be provided, thus resulting in a disadvantage that the cost of the arrangement is undesirably increased on the whole.

SUMMARY OF THE INVENTION

Accordingly, an essential object of the present invention is to provide a developer material supply arrangement for supplying developer material to a developing tank of an electrophotographic copying apparatus or the like, in which a hopper-shaped container for the developing material is adapted to be releasable with respect to a developer hopper mounting portion of the developing tank, thereby eliminating the necessity for detaching the developing tank from a copying apparatus main body during supplying of the developer material.

Another important object of the present invention is to provide an improved developer tank for the developing material supply arrangement, which neither requires to be taken out of the copying apparatus main body during supply of the developer material, or to be provided with a new mechanism for operating a device to discharge the developer material, by providing a valve means at a supply port of the hopper-shaped container which may be opened, following rotation of a developer material stirring device provided in the developing tank.

A further object of the present invention is to provide the developer material supply arrangement of the above described type, which is simple in construction and reliable in function, and can be readily incorporated into an electrophotographic copying apparatus or the like at low cost.

In accomplishing these and other objects, according to one preferred embodiment of the present invention, there is provided a developer material supply arrangement at an opening at the upper portion of a developing tank of an electrophotographic copying apparatus which includes a developer hopper mounting portion for detachably mounting a developer hopper thereon, a hopper-shaped container for the developer material, a supply port provided at a lower portion of the hopper-shaped container and formed into a configuration which can be detachably mounted with respect to the developer hopper mounting portion, and a valve member provided within the supply port for selective opening or closing the supply port.

The developer material supply arrangement further includes a rotating knob member coupled with a developer material stirring means in the developing tank and capable of manually rotating the developer material stirring means, at least one or more projections provided to extend outwardly from the peripheral surface of the rotating knob member, a rotary shaft for opening or closing the valve member of the hopper-shaped container, with the rotary shaft being led out of the supply port, a lever fixed to the rotary shaft thus led out, a spring member connected to the lever so as to urge the lever in a direction for closing the valve member during closing thereof, and in a direction opposite thereto during opening of the valve member, and a claw provided on the lever and arranged to be depressed by the projections of the rotating knob.

For supplying the developer material by the developer material supply arrangement according to the present invention as described above, the developer hopper is first detached from the developer hopper mounting portion of the developing tank, and then, the hopper-shaped container of the developer material supply arrangement of the present invention is mounted on the mounting portion instead of the developer hopper. In the above case, the supply port of the hopper-shaped container is closed by the valve member. Subsequently, the developer material stirring means including a magnet roller and a stirring roller is driven for rotation of the rotating knob member so as to turn the lever by pushing the claw by the projection, thereby opening the valve member for supplying the developer material to the developing tank from the supply port.

According to the present invention, since the developing material can be supplied in the manner as described above, it is not necessary to remove the developing tank from the copying apparatus housing during supply of the developer material, and moreover, owing to the arrangement that the developer material is discharged through utilization of rotation of the rotating knob member coupled with the developer material stirring means, the construction of the developer material supply arrangement may be simplified, with a consequent reduction in cost.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
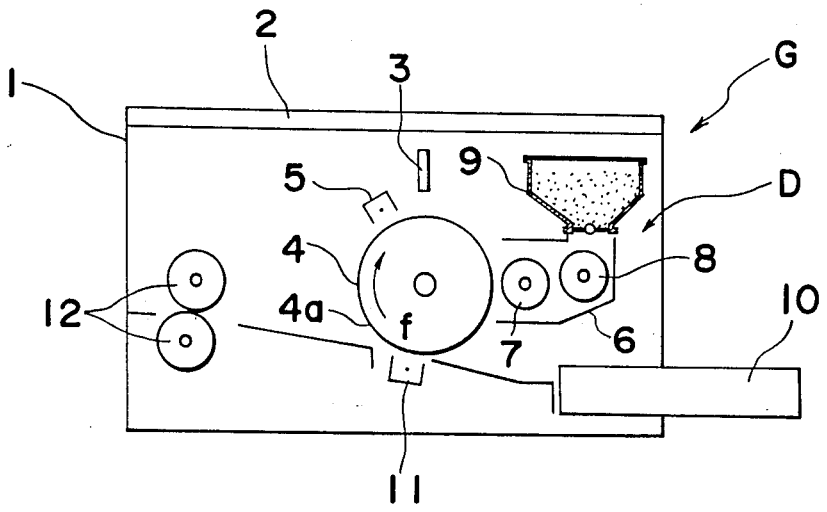
FIG. 1 is a schematic side sectional view of an electrophotographic copying apparatus to which the developer material supply arrangement according to the present invention may be applied.

Before the description of the present invention proceeds, it is to be noted that like parts are designated by like reference numerals throughout the accompanying drawings.

Referring now to the drawings, there is shown in FIG. 1 an electrophotographic copying apparatus to which a developer material supply arrangement according to the present invention may be applied.

In FIG. 1, the electrophotographic copying apparatus G generally includes an apparatus housing 1, a known photosensitive member or a photoreceptor drum 4 having a photosensitive surface 4*a* formed on the outer peripheral surface thereof and rotatably provided at approximately a central portion of the apparatus housing 1 for rotation in a direction indicated by an arrow f, a corona charger 5 for preliminarily charging the photosensitive surface 4*a* uniformly, an image transmitter 3 formed of a plurality of graded index fibers in bundled configuration for leading a light image of an original document (not shown) placed on an original document platform 2 onto the photosensitive surface 4*a* for exposure so as to form an electrostatic latent image of the original document thereon, a developing tank 6 for developing the electrostatic latent image into a visible toner image, including a magnet roller 7 and a stirring roller 8 therein and mounted with a hopper-shaped container 9 for the developer (toner) material supply arrangement D related to the present invention, a paper feeding cassette 10, a transfer charger 11 for transferring the visible toner image onto a copy paper sheet, and a set of fixing rollers 12 for fixing the toner image onto the copy paper sheet, all of which are sequentially disposed around the photoreceptor drum 4, as illustrated.

Figure 2:
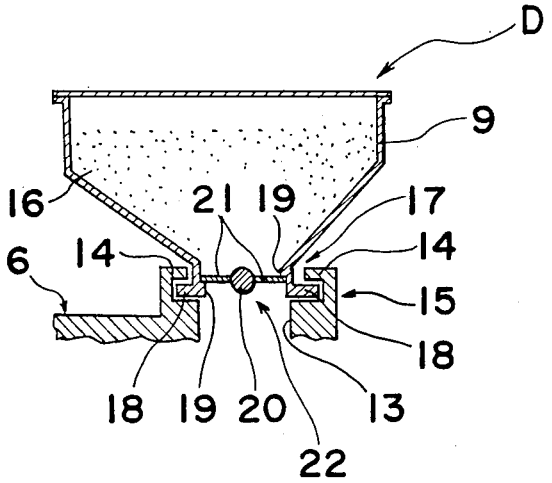
FIG. 2 is a side sectional view showing on an enlarged scale, the construction of a hopper-shaped container for the developer material supply arrangement employed in the copying apparatus of FIG. 1.
Figure 3:
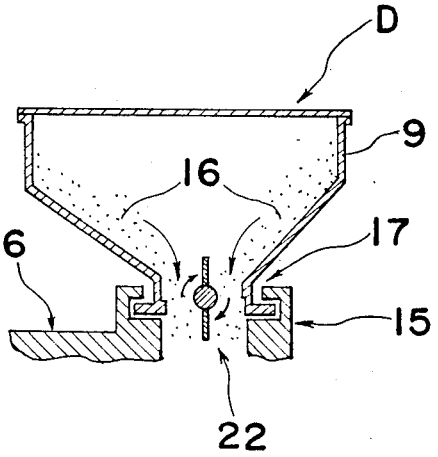
FIG. 3 is a view similar to FIG. 2, which particularly shows a valve member thereof in a different position.

Referring also to FIGS. 2 and 3, at a rear upper portion of the developing tank 6, there is provided an opening 13 elongated in an axial direction of the photoreceptor drum 4, and longitudinal grooves 14 formed in the opposed inner edges of the opening 13 to form a developer hopper mounting portion 15 for releasably receiving the toner hopper thereon.

Meanwhile, the hopper-shaped container 9 of the developer material supply arrangement D for accommodating the developer material 16 therein, has a supply port 17 provided at its lower portion and formed into an elongated shape similar to the opening 13 of the developing tank 6, with longitudinal flange portions 18 being provided at confronting lower edges of the supply port 17 so that the container 9 may be detachably mounted on the developer hopper mounting portion 15 by fitting the flange portions 18 thereof into the corresponding grooves 14 of the developing tank 6. It is to be noted here that the longitudinal grooves 14 are formed to be sufficiently larger in height than the flange portions 18 to provide a small gap therebetween so that the hopper-shaped container 9 may be vertically vibrated to a certain extent even when the flange portions 18 are fitted into the grooves 14.

Moreover, the hopper-shaped container 9 is provided, within the supply port 17 thereof, with valve seats 19, a longitudinal rotary shaft 20 disposed at a central portion between the valve seats 19, and valve plates 21 fixed to opposite sides of the rotary shaft 20 to form a valve member 22, to selectively open or close the supply port 17 through rotation of the rotary shaft 20.

Figure 4:
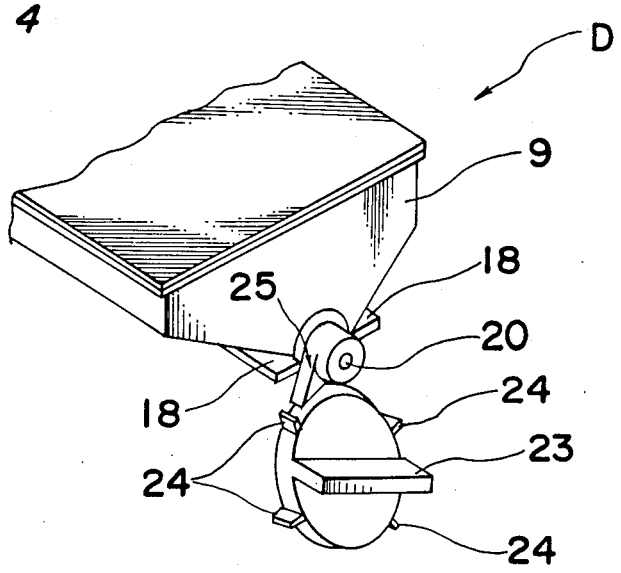
FIG. 4 is a fragmentary perspective view of the developer material supply arrangement of the present invention.
Figure 5:
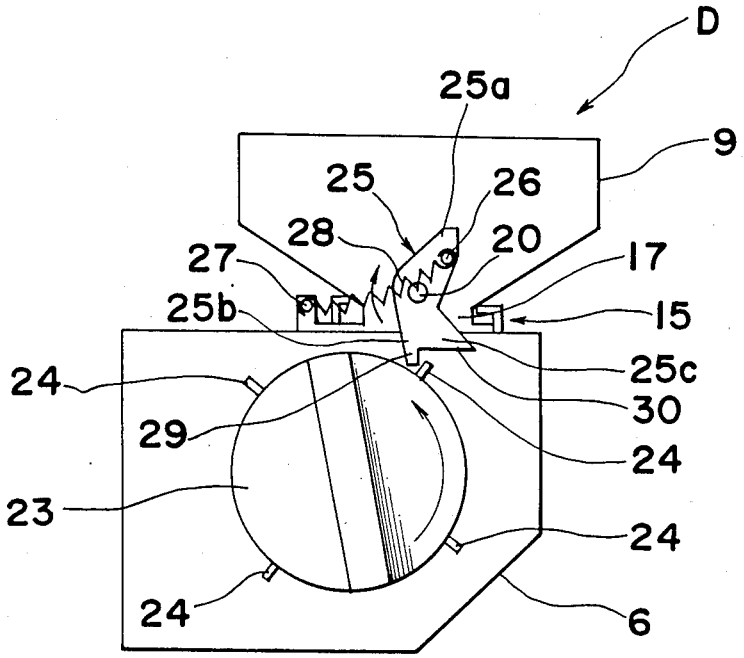
FIGS. 5 and 6 are schematic side elevational views of the developer material supply arrangement of the present invention for explaining functioning of a lever member and a rotating knob member thereof.
Figure 6:
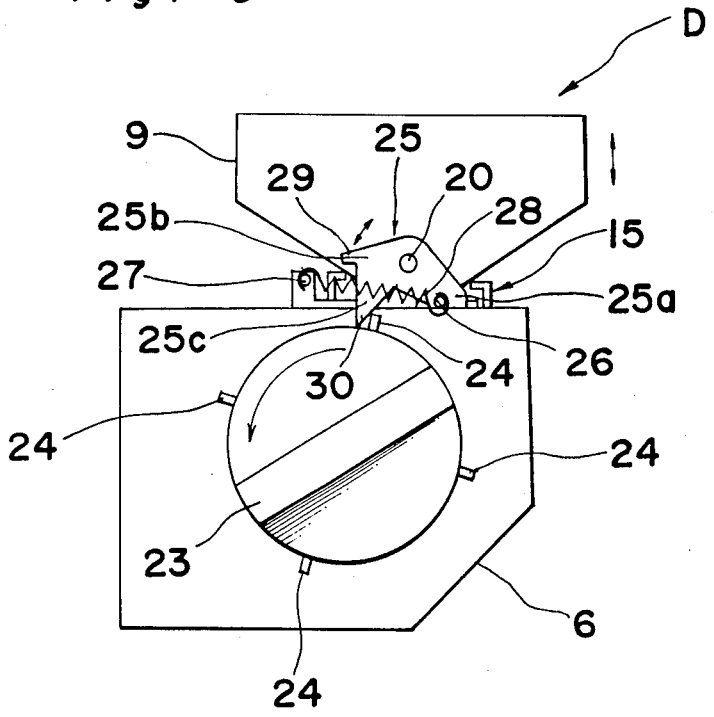
Figure 7:
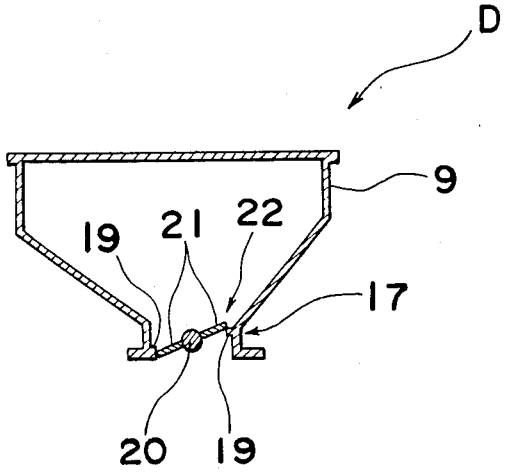
FIG. 7 is a view similar to FIG. 2, which particularly shows the valve member in a different position.

Referring further to FIGS. 4 through 6, below the developer hopper mounting portion 15 of the developing tank 6, a disc-shaped rotating knob member 23 is provided to extend sidewise to a certain extent. This rotating knob member 23 is coupled with a developing material stirring device including the magnet roller 7 and the stirring roller 8 provided in the developing tank 6 so as to manually rotate the developing material stirring device depending on necessity, and is provided, on its peripheral surface, with at least one or more projections, for example, four projections 24 protruding in four directions therefrom. Meanwhile, the hopper-shaped container 9 has one end of the rotary shaft 20 for operating the valve member 22 extended out of the supply port 17, with a lever 25 being fixed to this one end of the rotary shaft 20. A tension coil spring 28 is connected between a spring catch 26 provided adjacent to one end 25*a* of the lever 25 pivotally supported by the rotary shaft 20 and another spring catch 27 fixed to the forward end portion of the edge for the supply port 17, whereby, during closing of the valve member 22, this tension coil spring 28 is located above the rotary shaft 20, as shown in FIG. 5, so as to urge the lever 25 counterclockwise, i.e., in a direction for closing the valve member 22, while during opening of the valve 22, the spring 28 is positioned below the rotary shaft 20 for urging the lever 25 clockwise (FIG. 6). It is to be noted here that the lever 25 urged clockwise by the tension coil spring 28 during opening of the valve member 22, has its one end 25*a* engaged for stopping with the developing tank 6 while the hopper-shaped container 9 is mounted on the developer hopper mounting portion 15 so as to be prevented from any further rotation, thus maintaining the valve member 22 in the opened state. However, upon detachment of the hopper-shaped container 9 from the developer hopper mounting portion 15, with the one end 25*a* of the lever 25 being released from the engagement thereof with the developing tank 6, the lever 25 urged by the tension coil spring 28 is further rotated clockwise through approximately 90°, which means that the valve member 22 is rotated through about 180° in the direction opposite to the closing direction, with the valve plates 21 contacting the reverse side faces of the valve seats 19 to close the supply port 17, as shown in FIG. 7. Moreover, the lever 25 is also formed with a claw 29 at its end 25*b* which is to be directed downward upon closure of the valve member 22, so that, as shown in FIG. 5, upon mounting of the hopper-shaped container 9 on the developer hopper mounting portion 15 of the developing tank 6, when the knob 23 is rotated counterclockwise, this claw 29 is depressed by the projection 24 and the lever 25 is rotated from the closed position to the opened position of the valve member 22. Furthermore, the lever 25 is also formed, at the other end 25*c* thereof, with a cam portion 30, so that, as shown in FIG. 6, during the opening of the valve member 22, the cam portion 30 is depressed by the projection 24 through the counterclockwise rotation of the knob 23 so as to be moved upwardly.

By the construction as described so far, with the hopper-shaped container 9 mounted on the developer hopper mounting portion 15 of the developing tank 6, upon rotation of the knob 23 in the counterclockwise direction through driving of the developing material stirring device, the claw 29 is depressed by the projection 24 as shown in FIG. 5 and the lever 25 is rotated counterclockwise through about 90° against the urging force of the tension coil spring 28 so as to be brought into the state of FIG. 6. Thus, the valve member 22 is opened to feed the developer material 16 into the developing tank 6 through the supply port 17 of the hopper-shaped container 9. Upon further rotation of the knob 23, the cam portion 30 is depressed by the projection 24 and displaced upwardly, as shown in FIG. 6. In this case, however, the cam portion 30 is immediately returned downwardly by the weight of the hopper-shaped container 9 upon disengagement from the projection 24, and thereafter, repeats such vertical movement through rotation of the knob 23. When the cam portion 30 effects the vertical movement as described above, the lever 25 functions, with the one end 25*a* thereof which contacts the developing tank 6 acting as a fulcrum, and therefore, the hopper-shaped container 9 to which the rotary shaft 20 is pivotally connected as a functioning point of the lever 25, is subjected to vertical vibrations. Accordingly, the developer material 16 remaining within the hopper-shaped container 9 is also shaken off and fed into the developing tank 6 through the supply port 17, and thus, all the developer material 16 may be completely fed without any residual developer material in the container 9. Meanwhile, upon detachment of the hopper-shaped container 9 from the developer hopper mounting portion 15 after completion of the supply of the developer material 16, the supply port 17 is closed by the valve member 22, as shown in FIG. 7, and therefore, there is no possibility that a very small amount of the developer material 16 still remaining within the container 9 may fall through the supply port 17 to soil the surroundings.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developer material supply arrangement which comprises a developer hopper mounting portion for detachably mounting a developer hopper at an opening at an upper portion of a developing tank of an electrophotographic copying apparatus, a hopper-shaped container for developer material, a supply port provided at a lower portion of said hopper-shaped container and formed into a configuration such that said container can be detachably mounted with respect to said developer hopper mounting portion, a valve member comprising a rotary shaft provided within said supply port for selective opening or closing of said supply port, a rotating knob member provided outside said developing tank coupled with a developer material stirring means in said developing tank and capable of manually rotating said developing material stirring means, at least one projection provided to extend outwardly from a peripheral surface of said rotating knob member, said rotary shaft of said valve member extending out of said supply port and outside of said developing tank to be fixed to a lever which regulates the opening and closing of said supply port by said valve member, a spring member connected to said lever so as to urge said lever in a direction for the closing of said supply port by said valve member, and in a direction opposite thereto for opening of said supply port by said valve member, and a claw provided on said lever arranged to be depressed by said at least one projection on said rotating knob member for rotating said valve member from the closed position to the opened position when said hopper-shaped container is mounted on said developer hopper mounting portion of said developing tank.

2. A developer material supply arrangement as in claim 1, wherein said lever is arranged to contact, at its one end, said developing tank by being urged by said spring member during opening of said valve member, and to be capable of further rotating through approximately 90° owing to urging by said spring member when said lever is released from engagement with said developing tank upon detachment of said hopper-shaped container from said developer hopper mounting portion of said developing tank, said valve member including valve plates provided on said rotary shaft so as to selectively close or open said supply port through rotation of said rotary shaft together with said valve plates, and also being adapted to close said supply port when said rotary shaft is rotated through approximately 180° in a direction opposite to the direction for the closing.

3. A developer material supply arrangement as in claim 1, wherein said hopper-shaped container is adapted to be vertically vibratable when mounted on said developer hopper mounting portion through a gap provided at said mounting, said lever contacting said developing tank from above at its one end having said rotary shaft as a fulcrum during opening of said valve member, with the other end of said lever being formed into a cam portion which moves upwardly as depressed by said at least one projection through rotation of said rotating knob member.

4. A developer material supply arrangement as in claim 3, wherein said lever is arranged to contact, at its one end, said developing tank by being urged by said spring member during opening of said valve member, and to be capable of further rotating through approximately 90° owing to urging by said spring member when said lever is released from engagement with said developing tank upon detachment of said hopper-shaped container from said developer hopper mounting portion of said developing tank, said valve member including valve plates provided on said rotary shaft so as to selectively close or open said supply port through rotation of said rotary shaft together with said valve plates, and also being adapted to close said supply port when said rotary shaft is rotated through approximately 180° in a direction opposite to the direction for the closing.

* * * * *